US007261595B2

(12) United States Patent
Shino

(10) Patent No.: US 7,261,595 B2
(45) Date of Patent: Aug. 28, 2007

(54) ELECTRICAL CONNECTOR FOR FLAT CABLES AND SHIELD MEMBER USED THEREFOR

(75) Inventor: Yoshihiko Shino, Kanagawa (JP)

(73) Assignee: Tyco Electronics AMP K.K., Kanagawa-Ken (JP)

( * ) Notice: Subject to any disclaimer, the term of this patent is extended or adjusted under 35 U.S.C. 154(b) by 18 days.

(21) Appl. No.: 11/212,278

(22) Filed: Aug. 26, 2005

(65) Prior Publication Data

US 2006/0046559 A1 Mar. 2, 2006

(30) Foreign Application Priority Data

Aug. 27, 2004 (JP) ..... 2004-247844

(51) Int. Cl.
*H01R 13/648* (2006.01)

(52) U.S. Cl. ..... 439/607

(58) Field of Classification Search ..... 439/607, 439/495, 497, 609

See application file for complete search history.

(56) References Cited

U.S. PATENT DOCUMENTS

| | | | | |
|---|---|---|---|---|
| 5,882,223 | A * | 3/1999 | Igarashi | 439/495 |
| 5,961,348 | A * | 10/1999 | Murphy | 439/579 |
| 6,066,000 | A * | 5/2000 | Masumoto et al. | 439/607 |
| 6,183,281 | B1 * | 2/2001 | Wu et al. | 439/260 |
| 6,315,616 | B1 * | 11/2001 | Hayashi | 439/638 |
| 6,379,176 | B1 * | 4/2002 | Ohsawa et al. | 439/495 |
| 6,676,444 | B2 * | 1/2004 | Noro | 439/579 |
| 6,932,648 | B1 * | 8/2005 | Chiu et al. | 439/607 |

* cited by examiner

*Primary Examiner*—Tulsidas C. Patel
*Assistant Examiner*—Harshad C Patel
(74) *Attorney, Agent, or Firm*—Barley Snyder LLC

(57) ABSTRACT

An electrical connector for flat cables has an insulative housing, contacts and a shield member. The insulative housing is mountable onto a circuit board having a conductive pad. The contacts are disposed in the insulative housing for contacting a shield of a flat cable to be inserted into the connector. The shield member is mounted on the insulative housing so as to substantially cover the outer surfaces thereof and electrically connect the shield of the flat cable to the conductive pad of the circuit board when the shield member is mounted on the insulative housing.

4 Claims, 5 Drawing Sheets

ELECTRICAL CONNECTOR FOR FLAT CABLES AND SHIELD MEMBER USED THEREFOR

FIELD OF THE INVENTION

The present invention relates to an electrical connector and more particularly to a shielded electrical connector and a shield member for flat cables.

BACKGROUND

Japanese Unexamined Patent Publication No. 2000-231971 discloses in FIGS. 1 and 2, an electrical connector which is utilized to connect Flexible Printed Circuits (FPC's). This connector comprises a pair of connector halves wherein, one connector half is positioned over a circuit board, and other over the FPC. A shell which acts as a shield member is mounted on the exterior of each of the connector halves. A grounding conductor of the FPC is connected to the shell of the FPC side connector half.

In the known FPC connector, the shells are mounted on the exteriors of housings having predetermined shapes, thereby being built in to the connector. Accordingly, the shielding properties are stable. If such a connector is equipped with a openable/closable locking member, for connecting to a FPC or a Flexible Flat Cable (FFC), the locking member temporarily protrudes outward from housing when opened. Therefore, a shell such as that disclosed in the known FPC connector cannot be employed in a connector equipped with a locking member. Without a shell mounted on the exteriors of housings, problems arise in that spurious electromagnetic radiation being emitted from the connector itself, and external electromagnetic interference (EMI) are allowed to interfere with the electrical signals passing through the connector.

SUMMARY

The present invention has been developed in view of the foregoing circumstances. It is an object of the present invention, among others, to provide an electrical connector for flat cables and a shield member to be employed therefor, which have improved EMI performance.

The electrical connector for flat cables has an insulative housing, contacts and a shield member. The insulative housing is mountable onto a circuit board having a conductive pad. The contacts are disposed in the insulative housing for contacting a shield of a flat cable to be inserted into the connector. The shield member is mounted on the insulative housing so as to substantially cover the outer surfaces thereof and electrically connect the shield of the flat cable to the conductive pad of the circuit board when the shield member is mounted on the insulative housing.

BRIEF DESCRIPTION OF THE DRAWINGS

The invention will now be described by way of example with reference to the accompanying figures of which:

FIGS. 5A and 5B are partial sectional views of the electrical connector of FIG. 1, wherein FIG. 5A is a sectional view taken along line 5*a*–5*a* of FIG. 2, and FIG. 5B is a sectional view taken along line 5*b*–5*b* of FIG. 2;

FIGS. 6A and 6B illustrate the electrical connector of FIG. 1 having the shield member mounted thereon, wherein FIG. 6A is a plan view, and FIG. 6B is a side view;

DETAILED DESCRIPTION OF THE EMBODIMENTS

Figure 1:
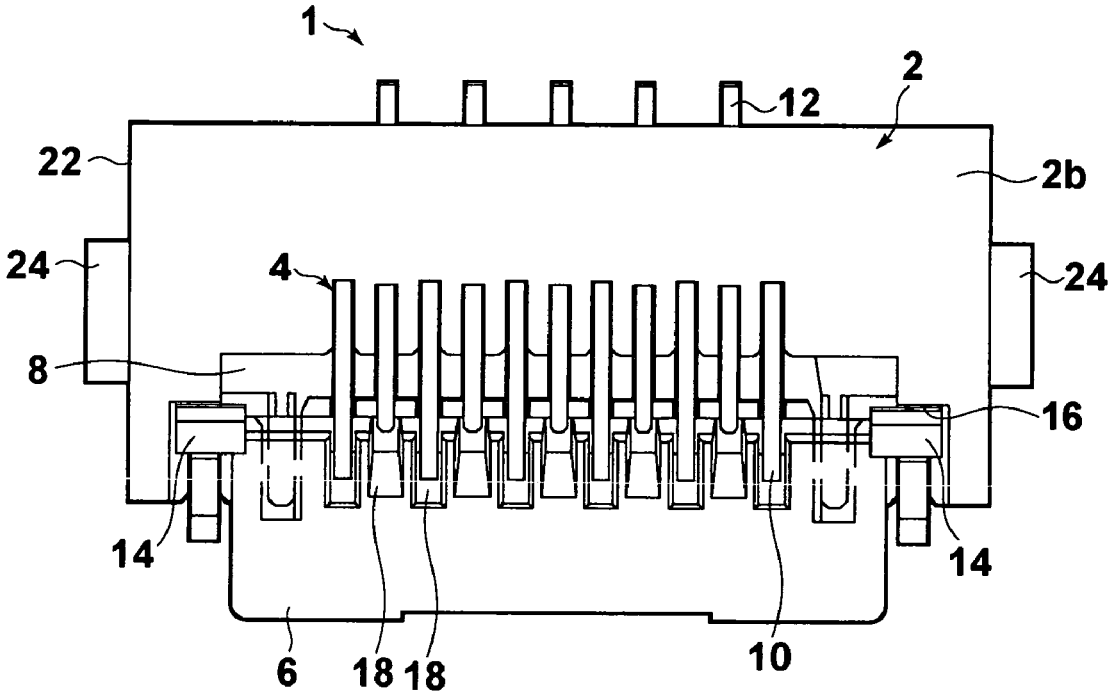
FIG. 1 is a plan view of an electrical connector for flat cables according to an embodiment of the present invention, with a shield member removed.
Figure 2:
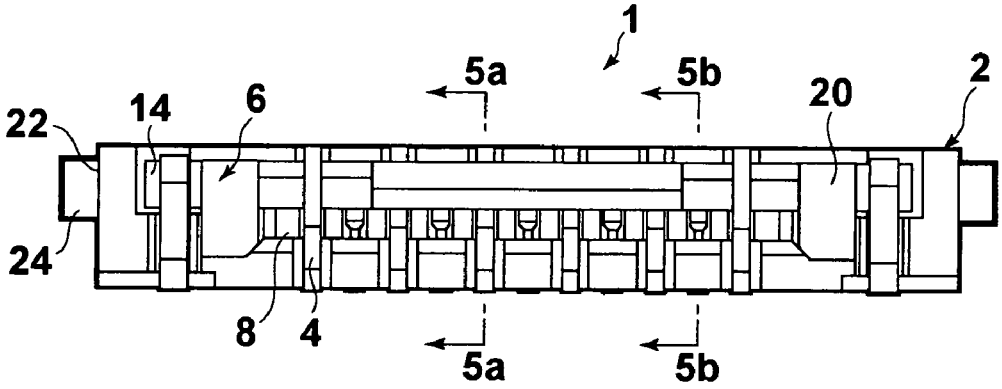
FIG. 2 is a front view of the electrical connector of FIG. 1.
Figure 3:
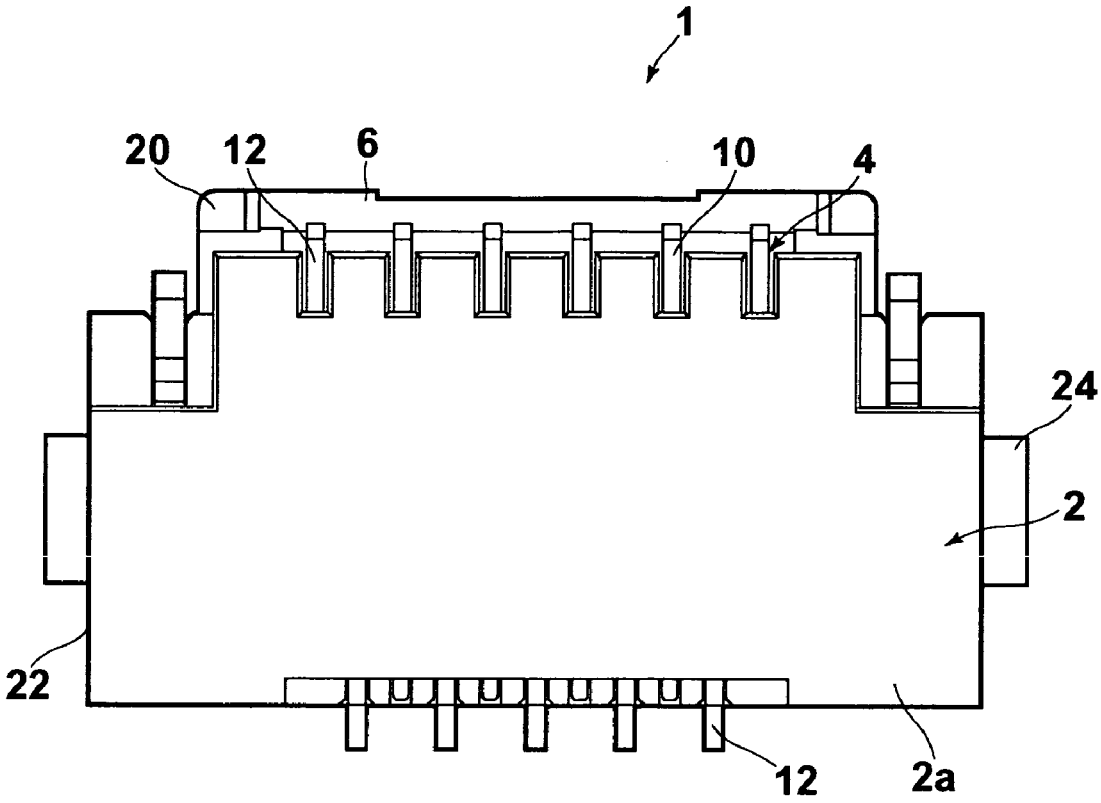
FIG. 3 is a bottom view of the electrical connector of FIG. 1.

An electrical connector 1 for flat cables, hereinafter, simply referred to as a connector, according to a preferred embodiment of the present invention will now be described in greater detail, with reference to the attached drawings. Referring first to FIGS. 1 through 4 which illustrate the outer appearance of the connector 1, it should be noted that a shield member 30 is omitted for purposes of describing the other major components. The connector 1 includes an insulative housing 2, hereinafter, simply referred to as a housing, a plurality of contacts 4, which are provided in the housing 2 and a locking member 6, which is pivotally supported by the housing 2 so as to be openable and closable.

Figure 6A:
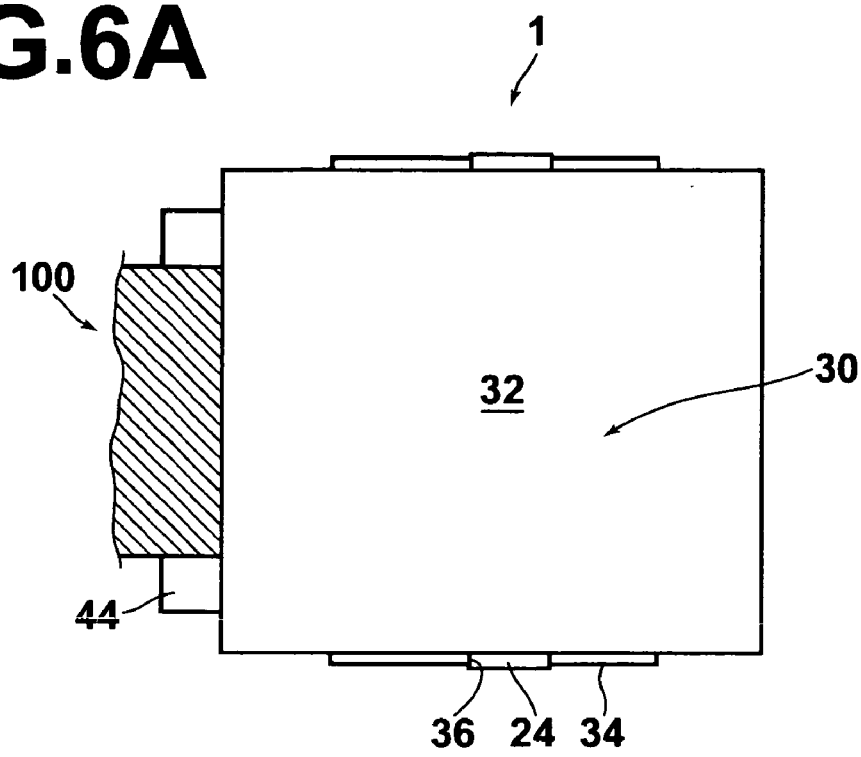

A cable receiving recess 8 that opens along the longitudinal direction of the connector 1 is located in the front side of the housing 2. The contacts 4 extend in parallel to each other along the cable receiving recess 8. Note that the front side refers to the side of the connector 1, at which a flat cable 100, hereinafter, simply referred to as a cable, is inserted as illustrated in FIG. 6A. Tines 12 of the contacts 4 protrude slightly from the bottom surface 2*a* of the housing 2. The tines 12 are surface mountable onto a circuit board 80.

Figure 5A:
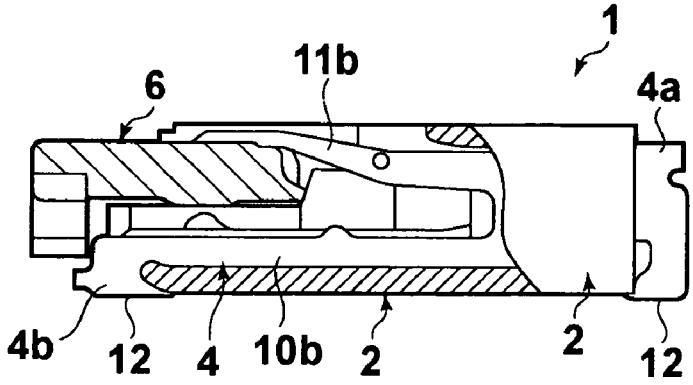
Figure 5B:
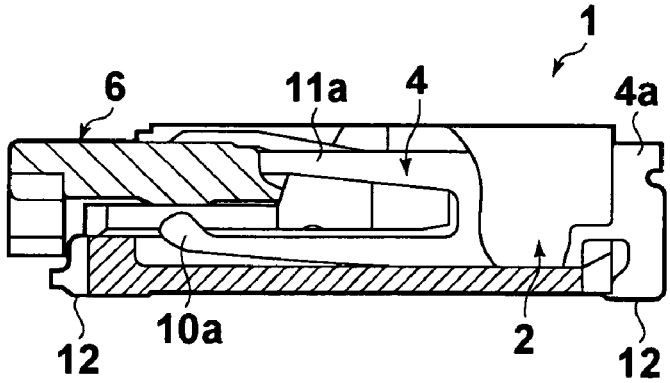

The shapes of the contacts 4 will now be described with reference to FIGS. 5A and 5B. The contacts 4 include two types of contacts, 4*a* and 4*b*. The contacts 4*a* are inserted and press fit into the housing 2 from the rear portion thereof Each contact 4*a* has a contact arm 10*a*, located at the lower end of the contact 4*a*, that protrudes into the cable receiving recess 8, and a pressing arm 11*a*, located at the upper end of the contact 4*a*. The contacts 4*b* are inserted and press fit into the housing 2 from the front portion thereof. Each contact 4*b* has a contact arm 10*b*, located at the lower end of the contact 4*b*, and a pressing arm 11*b*, located at the upper end of the contact 4*b*. The contacts 4*a* and 4*b* electrically contact the cable 100 via their respective contact arms 10*a* and 10*b*. The pressing arms 11*a* and 11*b* press the cable 100 downward, via the locking member 6 as will be explained in further detail below.

Next, the locking member 6 will be described. Referring to FIG. 1, the locking member 6 is a planar insulative member having axels 14 extending outward at each end thereof The axels 14 fit into corresponding grooves 16 of the housing 2, such that the locking member 6 is rotatably supported by the housing 2. Rectangular openings 18 are formed in the locking member 6 at positions corresponding to the pressing arms 11*a* and 11*b*, so that the locking member 6 will not interfere with the contacts 4. The openings 18 are formed such that they open toward the front end of the locking member 6. Accordingly, the pressing arms 11*a* and 11*b* are capable of pressing the cable 100 downward via the locking member 6, by pressing the locking member 6 downward.

Figure 4:
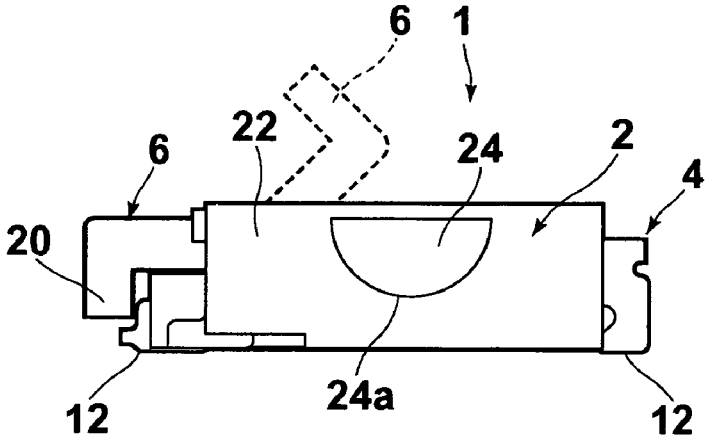
FIG. 4 is a side view of the electrical connector of FIG. 1.

The lock member 6 is closed to secure the cable 100 after the cable 100 is inserted into the cable receiving recess 8. Downwardly protruding alignment members 20 (FIG. 2) are formed at both ends of the lock member 6 toward the front side thereof. The alignment members 20 limit horizontal movement of the inserted cable 100, that is, movement in the width direction of the cable 100. Referring to FIG. 4, substantially semicircular protrusions 24, which have a curved surface 24*a* on the bottom thereof, are formed on each side wall 22 of the hosing 2. The protrusions 24 engage with the shield member 6, as will be described later.

Figure 6B:
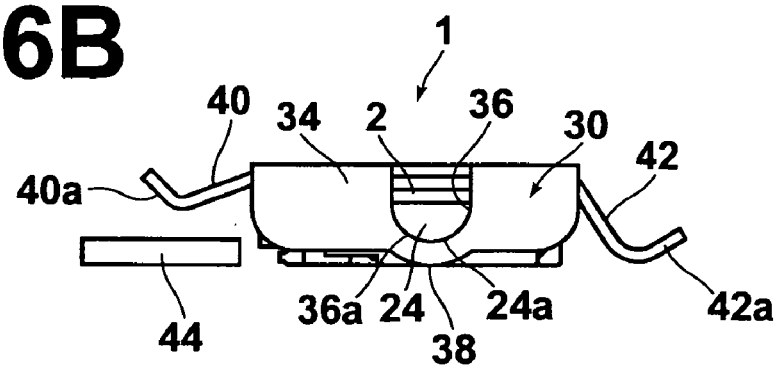

Next, the connector 1 will be described with the shield member 30 mounted on the housing 2 with reference to FIGS. 6A and 6B. The shield member 30 is formed by stamping and forming a metal plate. The material of the shield member 30 may be a copper alloy having elasticity, such as phosphor bronze. The shield member 30 has a rectangular base 32 that covers the upper surface 2*b* of the housing 2 (FIG. 1) and a pair of substantially rectangular mounting pieces 34, which are bent toward the side walls 22 of the housing 2 from the base 32 and formed into clips. The mounting pieces 34 are sized to cover the side walls 22, and have openings 36 for engaging the protrusions 24 formed therein, at positions that correspond to the protrusions 24. The openings 36 have curved surfaces 36*a*, which are complementary to the curved surfaces 24*a* (refer to FIG. 4) of the protrusions 24. The protrusions 24 and the openings 36 serve as pivot points that allow the shield member 30 to rock thereon. A downwardly protruding curved protrusion 38 is formed at the bottom end of each mounting piece 34, in the vicinity of the opening 36.

Downwardly extending tongues 40 and 42 are formed at the front or first end and the rear or second end of the shield member 30, respectively. The tongue 40 extends toward the cable 100, and the tip 40*a* thereof is bent upward. The tongue 42 extends toward the circuit board 80, and its tip 42*a* is bent upward in a manner similar to that of the tip 40*a*. The upward bends of the tips 40*a* and 42*a* enable stable and positive electrical contact, without impeding the rocking movement of the shield member 30. Note that in FIGS. 6A and 6B, reference number 100 denotes the cable, which has been inserted into the connector 1, and reference number 44 denotes a base plate, separate from the housing 2.

Figure 7:
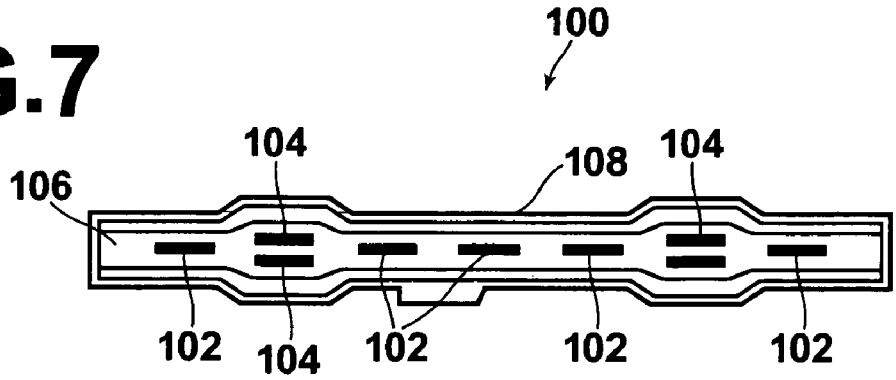
FIG. 7 is an end view of an exemplary flat cable.

Next, an example of the cable 100 will be described with reference to FIG. 7. FIG. 7 is a sectional view of the cable 100. The cable 100 comprises a plurality of signal conductors 102, which are arranged generally parallel to each other at a predetermined spacing and grounding conductors 104, which are arranged at predetermined positions. The conductors 102 and 104 are overmolded within an insulator 106. The outer surfaces of the insulator 106 are covered by a conductor, such as aluminum foil, to form a shield surface 108. In the present embodiment, the shield surface 108 is provided so as to cover the entire insulator 106. However, the shield surface 108 may be provided so as to cover either the upper surface or the lower surface of the insulator 106. In this case, the shield surface 108 may be formed on the entire upper or lower surface, or only on a portion thereof.

Figure 8:
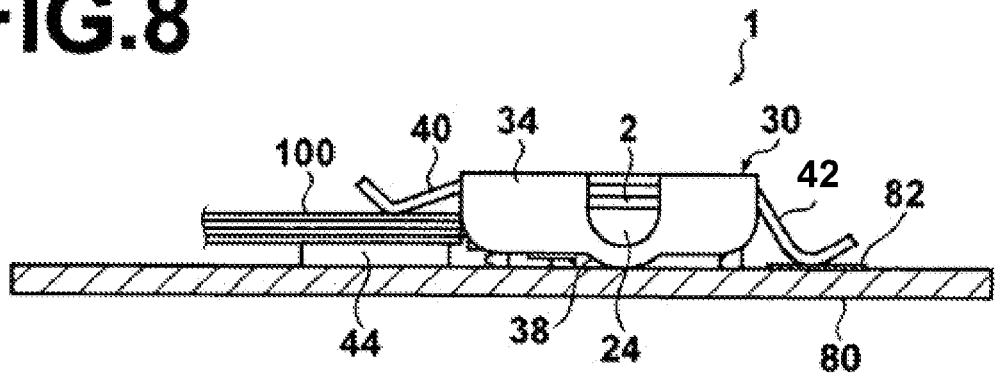
FIG. 8 is a side view of the electrical connector FIG. 1 mounted on a circuit board.

Next, mounting of the connector 1 onto the circuit board 80 will be described with reference to FIG. 8. The cable 100 is attached to the connector 1 by first opening the locking member 6 to the position illustrated by broken lines in FIG. 4, then inserting the cable 100 into the connector 1, and then closing the locking member 6. Thereafter, the shield member 30 is mounted onto the hosing 2. At this time, the curved protrusions 38 on the mounting pieces 34 abut the circuit board 80, restricting downward displacement of the mounting pieces 34 to prevent contact between the shield member 30 and the contacts 4. The shield member 30 is mountable on the housing 2 after the cable 100 is attached thereto in this manner. Therefore, the shield member 30 can be mounted onto the housing 2 even if a member that temporarily protrudes from the housing 2, such as the locking member 6, is open. In addition, the shield member 30 is mounted after mounting of the housing 2 onto the circuit board 80 and after the cable 100 is attached to the housing 2. Therefore, the soldering of the housing 2 on the circuit board 80 and the connection of the cable 100 can be easily confirmed prior to mounting of the shield member 30.

The tongue 40 contacts the shield surface 108 of the cable 100, and the tongue 42 contacts a conductive pad 82 such as a ground pad of the circuit board 80. The tongues 40 and 42 of the shield member 30 are resilient, so they are resiliently biased against the shield surface 108 of the cable 100 and the conductive pad 82. Thereby, the entire housing 2 is covered by the shield member 30, to shield the connector 1. The base plate 44 is mounted on the circuit board 80 at a position beneath the tongue 40, to support the cable 100 against the pressing force exerted thereon. Thereby, the contact between the shield surface 108 of the cable 100 and the tongue 40 is stabilized. The material of the base plate 44 is not particularly limited, and may be of the same material as that of the circuit board 80. Alternatively, in the case that the base plate 44 is a metallic plate which is soldered onto the conductive pad 82 of the circuit board 80, an electric connection can be established between the base plate 44 and the shield surface 108 formed on the bottom surface of the cable 100.

In this manner, the shield member 30 is mounted on the housing 2 such that it is capable of rocking, with the curved protrusions 38 as the pivot point s. That is, the shield member 30 automatically balances out the difference in reactive forces received by the tongues 40 and 42, by rotating about the curved protrusions 38. Thereby, contact by the tongues 40 and 42 are favorably maintained.

Figure 9:
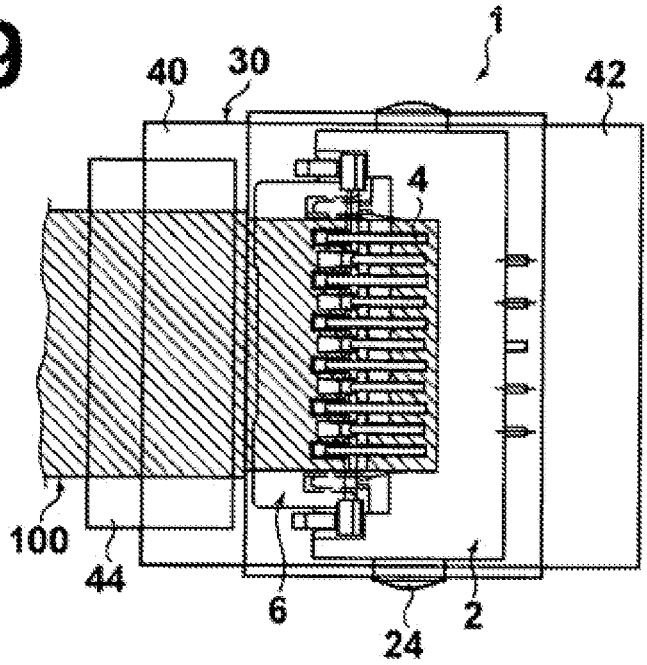
FIG. 9 is a plan view that transparently illustrates the positional relationships among an insulative housing, a shield member, a flat cable, and a base plate of the electrical connector of FIG. 1.
Figure 10:
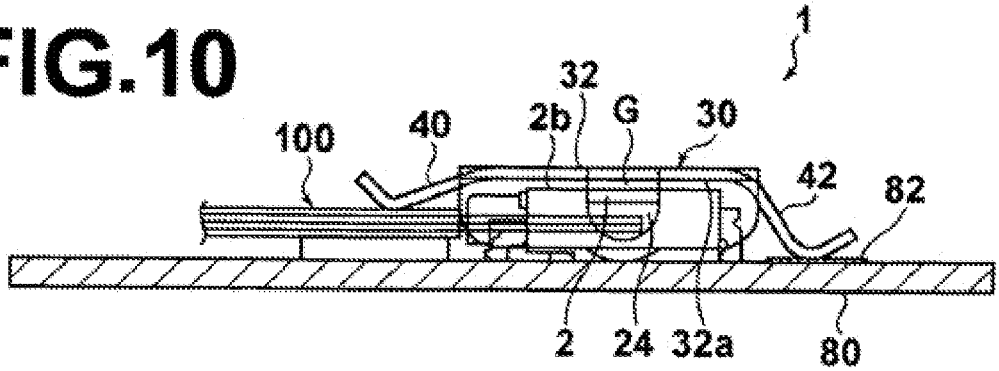
FIG. 10 is a side view that transparently illustrates the positional relationships among the insulative housing, the shield member, the flat cable, and the base plate of the electrical connector of FIG. 1.

Next, the positional relationships among the housing 2, the shield member 30, the cable 100, and the base plate 44 will be described with reference to FIGS. 9 and 10. Note that in FIGS. 9 and 10, the cable 100 is indicated by the hatched portions. FIG. 9 illustrates a state in which electrodes (not shown) at the tip of the cable 100 are in contact with the contacts 4. In addition, as illustrated in FIG. 10, a gap G is located between the upper surface 2*b* of the housing 2 and the bottom surface 32*a* of the base 32 of the shield member 30. The gap G enables rocking motion of the shield member 30 with the curved protrusions 38 as pivot points s, without interfering with the housing 2.

Although an embodiment of the present invention has been described above, the present invention is not limited to connectors which are surface mounted onto circuit boards. The present invention is applicable to connectors, in which contacts are inserted through and soldered to through holes (apertures) of circuit boards as well. It should be understood that flat cables as used herein include FFCs, in which a plurality of wires are arranged in parallel within a planar insulator, and FPCs, in which conductive paths are printed on a flexible circuit board.

Advantageously, the shield member 30 that covers the insulative housing 2 establishes a grounding path between the flat cable 100 and the conductive pad 82 of the circuit board 80. Therefore, the EMI properties of the electrical connector 1 for flat cables can be improved. Also, when the shield member 30 is mounted onto the insulative housing 2, the tongue 40 at the first end contacts the shield surface 108 of the flat cable 100, and the tongue 42 at the second end contacts the conductive pad 82 of the circuit board 80. Accordingly, the shield member 30 of the present invention exhibits the following advantageous effects. The shield member 30 that covers the insulative housing 2 establishes a ground path between the flat cable 100 and the conductive pad 82 of the circuit board 80. Therefore, the EMI performance of the electrical connector 1 is improved. Further, because the shield member 30 is mounted on the insulative housing 2 via the resilient mounting pieces 34 such that the tongue 40 at the first and second ends resiliently contacts the shield surface 108 of the flat cable 100 and the conductive pad 82 of the circuit board 80, respectively, the electrical contacts are stabilized, and the EMI properties are stably improved.

What is claimed is:

1. An electrical connector for flat cables, comprising:

an insulative housing, which is mountable onto a circuit board having a conductive pad;

a plurality of contacts disposed in the insulative housing for contacting a shield of a flat cable to be inserted into the connector and having tines being connectable to the circuit board; and a shield member, which is mounted on the insulative housing so as to substantially cover the outer surfaces thereof and the tines, the shield member electrically connecting the shield of the flat cable and the conductive pad of the circuit board when the shield member is mounted on the insulative housing;

wherein the shield member further comprises resilient mounting pieces formed as clips for mounting of the shield member onto the insulative housing in a removable manner;

wherein the shield member further comprises tongues provided at a first end and a second end of the shield member, wherein the tongue at the first end resiliently contacts a shield surface of the flat cable and the tongue at the second end resiliently contacts a conductive pad on the circuit board, and wherein the shield member is supported by the mounting pieces which have pivot points between the first end and the second end.

2. The electrical connector for flat cables as defined in claim 1, wherein protrusions that contact the circuit board to restrict movement of the shield member toward the circuit board are provided on the mounting pieces.

3. A shield member for a flat cable electrical connector comprising:

resilient mounting pieces formed as clips;

a tongue at a first end of the shield member;

a tongue at a second end of the shield member; and protrusions located between the first and second ends; the protrusions serving as pivot points on which the shield member rocks;

the tongue at the first end resiliently contacting a shield of a flat cable and the tongue at the second end resiliently contacting a conductive pad of the circuit board, when the shield member is mounted on the insulative housing.

4. The shield member as defined in claim 3, further comprising protrusions formed on the mounting pieces that contact the circuit board to restrict movement of the shield member toward the circuit board.

* * * * *